United States Patent [19]

Bulso, Jr. et al.

[11] Patent Number: 4,800,743

[45] Date of Patent: Jan. 31, 1989

[54] METHOD AND APPARATUS FOR ACCOMMODATING THERMAL EXPANSION AND OTHER VARIANCES IN PRESSES

[75] Inventors: Joseph D. Bulso, Jr., Canton; James A. McClung, North Canton, both of Ohio

[73] Assignee: Redicon Corporation, Canton, Ohio

[21] Appl. No.: 78,869

[22] Filed: Jul. 28, 1987

[51] Int. Cl.[4] ..... B21D 28/02

[52] U.S. Cl. ..... 72/336; 72/348

[58] Field of Search ..... 72/336, 335, 329, 348, 72/347, 359

[56] References Cited

U.S. PATENT DOCUMENTS

| | | | |
|---|---|---|---|
| 1,930,565 | 10/1933 | Rode et al. | 113/50 |
| 2,413,591 | 12/1946 | Sturdy | 113/42 |
| 3,695,084 | 10/1972 | Siemonsen et al. | 72/348 |
| 3,902,347 | 9/1975 | Ridgway et al. | 72/336 |
| 3,948,075 | 4/1976 | Finsterwalder et al. | 72/351 |
| 4,051,707 | 10/1977 | Valek et al. | 72/348 |
| 4,125,009 | 11/1978 | Byrd et al. | 72/350 |
| 4,206,701 | 6/1980 | Hemmelgarn | 100/257 |
| 4,207,048 | 6/1980 | Seymour | 425/151 |
| 4,249,410 | 2/1981 | Crago et al. | 72/347 |
| 4,375,785 | 3/1983 | Schoch et al. | 100/35 |
| 4,377,084 | 3/1983 | Kaminski | 72/325 |
| 4,455,114 | 6/1984 | Zysset | 413/14 |
| 4,624,125 | 11/1986 | Bulso, Jr. et al. | 72/453.13 |

*Primary Examiner*—Daniel C. Crane
*Attorney, Agent, or Firm*—Reese Taylor

[57] ABSTRACT

A method of controlling the spacing between a material forming punch and a complemental die includes advancing a punch shell and a pressure sleeve into engagement with the material and holding the material with the sleeve and blanking it with the punch shell. The material is then preliminarily formed by clamping the periphery between the pressure sleeve and a die core ring and advancing a punch core past the top of the die core ring and clamping the material against a die core to establish the desired dimension. The material is then finally formed by further advancement of the punch core with the die core and die core ring moving together. The apparatus includes a die core and die core ring which are concentrically arranged and independently supported but movable into engagement with each other after a predetermined amount of travel so as to move together through any further travel caused by movement of a punch core against the die core.

9 Claims, 9 Drawing Sheets

METHOD AND APPARATUS FOR ACCOMMODATING THERMAL EXPANSION AND OTHER VARIANCES IN PRESSES

BACKGROUND OF THE INVENTION

This invention relates, in general, to the forming of material in a reciprocating press having a movable slide or slides which move toward and away from a fixed base. The invention relates, in particular, to apparatus of this type wherein a relatively thin piece of material is formed and wherein it is necessary to precisely control the space or gap between the metal forming punch carried by the movable slide and the complemental forming die mounted on the bolster of the fixed base.

DESCRIPTION OF THE PRIOR ART

It is well known in forming thin workpieces to draw a flat sheet of metal or other material by moving a forming punch toward and away from a fixed forming die thereby drawing the material and imparting the desired configuration to the workpiece.

One example of such an operation is the forming of what are generally called "shells" which are the end pieces of two-piece or three-piece containers for beverages or other substances.

In this example, the length of the chuckwall which must be engaged by a seaming chuck so as to be double seamed onto the end of the container is critical. Deviations from specifications can result in container leakage and failure. Therefore, it is extremely important that the specification dimensions be maintained during production.

Controlling this dimension is extremely difficult, particularly in instances of high speed operation where, for example, something on the order of several hundred ends per minute or more are produced in multiple out die sets.

It will be obvious that similar dimensional control requirements will frequently exist in forming other products as well.

The problem is complicated even further by the fact that the normal thermal expansion of the press will create press variances since, as the press warms up, its components will typically expand from 0.005 to 0.006 inches with the result that the punch will travel further and the gap or space referred to above will vary.

It is possible, of course, to stop the press and reset the stroke. However, this naturally is undesirable since it results in interrupted production. It is also not fully effective either since every time the press is shut down for any reason, it will cool back down and the adjustment will have to be corrected.

The prior art has generally recognized the problem of controlling the spacing between the punch and the die in this environment. Conventionally, the primary method of doing this is by providing stop blocks on the press structure itself which will restrict the closing movement of the press so as to control the space between the tooling carried by the movable member and the tooling carried by the fixed member. One difficulty with this basic approach to the problem is that it does not effectively fully compensate for the thermal expansion of the press during operation.

An example of this approach can be seen in Byrd U.S. Pat. No. 4,125,009 wherein the downward moving forming apparatus abuts a fixed spacer which thus fixes the gap between the forming member and the die. In this apparatus, the press bottoms out each cycle and, since the gap or spacing is fixed, is not capable of compensating for differences in geometry due to heating of the press. A further example of this approach is disclosed by the use of the spacer bars in Crago U.S. Pat. No. 4,249,410.

The difficulty with solid stop blocks is recognized in Kaminski U.S. Pat. No. 4,377,084 wherein the usual stop blocks are augmented by resilient stop blocks which are positioned between the ram or slide and the bed of the press and which are compressed during the downward movement. Seymour U.S. Pat. No. 4,207,048 also teaches the utilization of spacers which are clamped between the tool and the ram or between the tool and the press bed. Here, a heat softenable rigid plastic is employed which normally controls the spacing, but is also capable of being heated and softened in the event there is a jam of the press.

Other approaches to solving the spacing problem involve controlling the shut height by using a split ring arrangement on the press driving apparatus and such an approach can be seen in Hemmelgarn U.S. Pat. No. 4,206,701.

Another approach is to attempt to obtain thermal stability in the press itself so as to control the shut height by using waste heat from the lubricant and circulating it through the drive assembly to heat the uprights to insure equal thermal growth of the uprights and the connections. Such a solution, which can be seen in Schoch U.S. Pat. No. 4,375,985, however, requires fairly complicated valving.

Bulso U.S. Pat. No. 4,624,126 illustrates yet another approach directed specifically to the formation of shells and wherein structure is provided outside the perimeter of the workpiece to control spacing in a secondary operation after the essential forming operation is completed.

SUMMARY OF THE INVENTION

While that invention is suitable for its intended purpose, the present invention is intended to permit individual control in a multiple out press and to do so within the perimeter of the workpiece thereby saving tooling space and permitting individual control of the tolerances.

It has, therefore, been found that improved dimensional control can be attained by providing an apparatus in which, during the forming operation, the material is formed over a die core ring by engagement with a telescoping punch which bottoms on an opposed die core to establish the desired dimension. The apparatus is such that, at the time at which the dimension is established, the die core is moved into engagement with the die core ring so that any further movement of the punch results in simultaneous movement of the die core and die core ring without disturbing the relative disposition of the tooling components.

To that end, the die core and die core ring are normally independently supported by fluid pressure or otherwise but, under the influence of the punch after a predetermined travel, the die core is forced into physical engagement with the die core ring so that they will move together.

In this fashion, further forming may take place without disturbing the critical dimension and without regard to thermal expansion of the press or other press variances.

Accordingly, production of an improved method and apparatus for accommodating press variances of the character above-described becomes the principal object of this invention with other objects thereof becoming more apparent upon a reading of the following brief specification, considered and interpreted in view of the accompanying drawings.

OF THE DRAWINGS

BRIEF DESCRIPTION OF THE PREFERRED EMBODIMENTS

Figure 1:
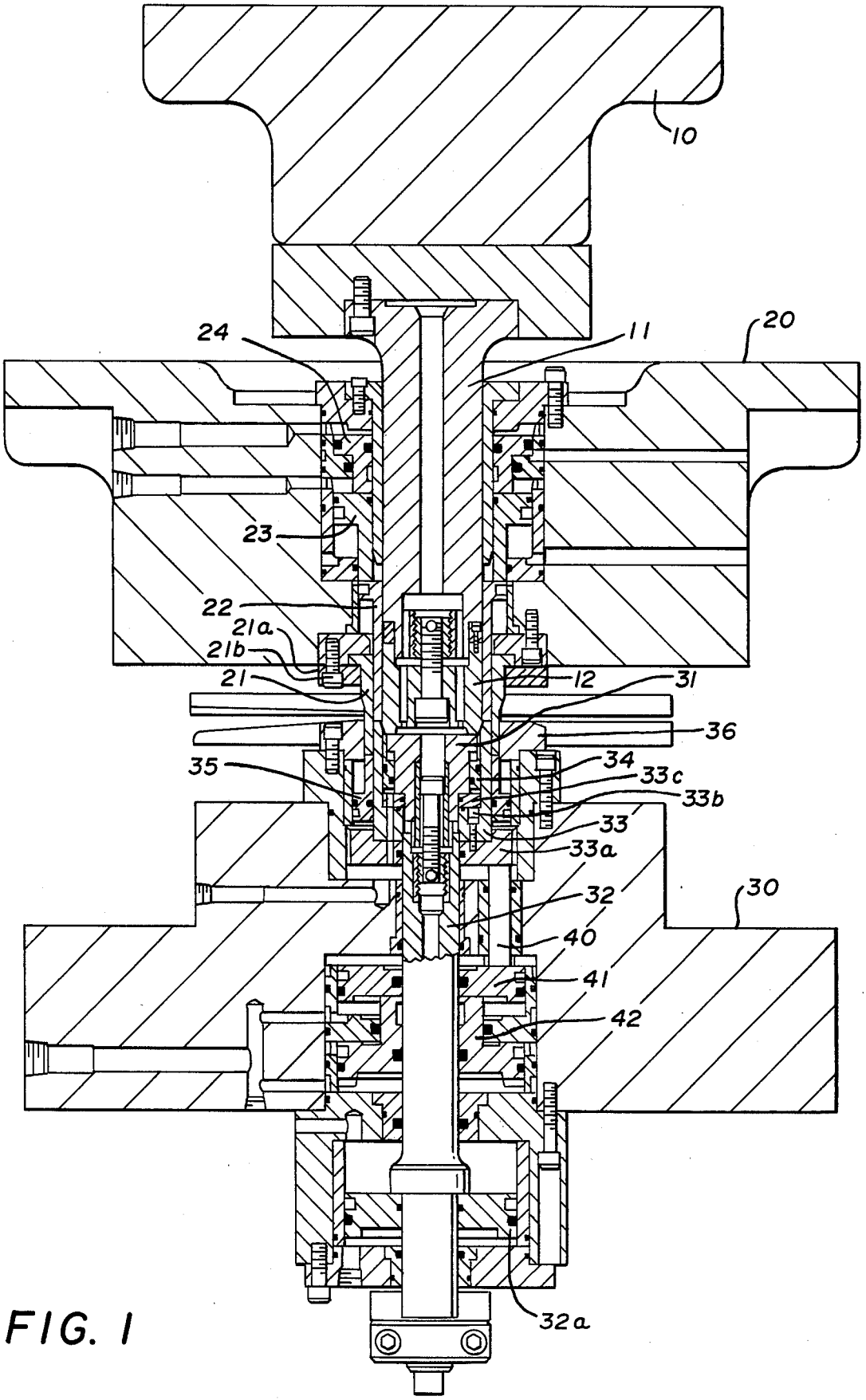
FIG. 1 is an elevational view, partially in section, illustrating the tooling components in the final formed position.

Referring first to FIG. 1 for a general description of the tooling components, it will, as previously noted, be understood that this invention is intended to be utilized in conjunction with a double acting press of the general type illustrated in Ridgway U.S. Pat. No. 3,902,347.

Such presses are well-known in the metal forming art and are not illustrated in great detail herein. It is important to note, however, that in general terms, the press includes inner and outer slides which are movable toward and away from a fixed base and which are adjustable and controllable independently of each other by a series of cams and throws driven by a fly wheel.

With that general description of the press structure in mind, it will be noted from FIG. 1 of the drawings that the press includes an inner slide holder 10 and an outer slide holder 20. These are disposed in opposed relationship to a fixed base 30 and are reciprocal with respect thereto.

The inner slide holder 10 has affixed to it a punch code riser 11 and a punch core 12. These components are attached by suitable attachment means, such as screws, as illustrated in the drawings, so that the riser 11 and the punch core 12 move together with the inner slide holder 10 which is, of course, attached to the inner slide of the press.

Outer slide holder 20, which is attached to the outer slide of the press, also carries several tooling components as will now be described.

First, a punch shell 21 is affixed to the outer slide holder 20, as clearly shown in the drawings, by a retainer **21*a* and suitable screws or bolts 21*b* and surrounds the punch core 12 and riser 11**.

Inboard of the punch shell 21 is an upper pressure sleeve 22 which is movable relatively of the outer side holder 20 and which is acted upon by stacked pistons 23 and 24 under a suitable source of fluid pressure, as will be more fully described below.

The base 30 also carries the remaining tooling components.

First, a die core 31 is mounted on a die core riser 32 suitably driven either by a fluidly operated piston **32*a*, as illustrated, or by other means such as cams, for example. The die core 31 is disposed in generally opposed relationship with respect to the punch core 12** and cooperates therewith as will be described below.

Outboard of the die core 31 and, concentric therewith, is a knockout piston 34 which is fluidly operated and which generally plays no part in the formation of the workpiece until the workpiece is finally completed and is ready to be lifted out of the die cavity.

Further outboard from the knockout piston 34, and concentric therewith, a die core ring 33 which is secured to a die core ring pad **33*a* and which is L-shaped in cross section as shown in FIG. 1. A die core spacer 33*c* rests on top of the upper edge portion of the die core ring 33 and is, of course, capable of varying the spacing between the die core 31 and the die core ring 33**.

Die core ring 33 rests on a die core ring pad **33*a* which is, in turn, supported by one or more support rods 40 which are, in their turn, supported by pistons 41 and 42** which are fluidly actuated.

Outboard of the die core ring 33, and concentric therewith, is a lower pressure sleeve 35 which is also fluidly actuated and which is disposed in generally opposed relationship with respect to the punch shell 21.

It will also be noted that the die core ring 33 is disposed in generally opposed relationship to the upper pressure sleeve 22.

Figure 2:
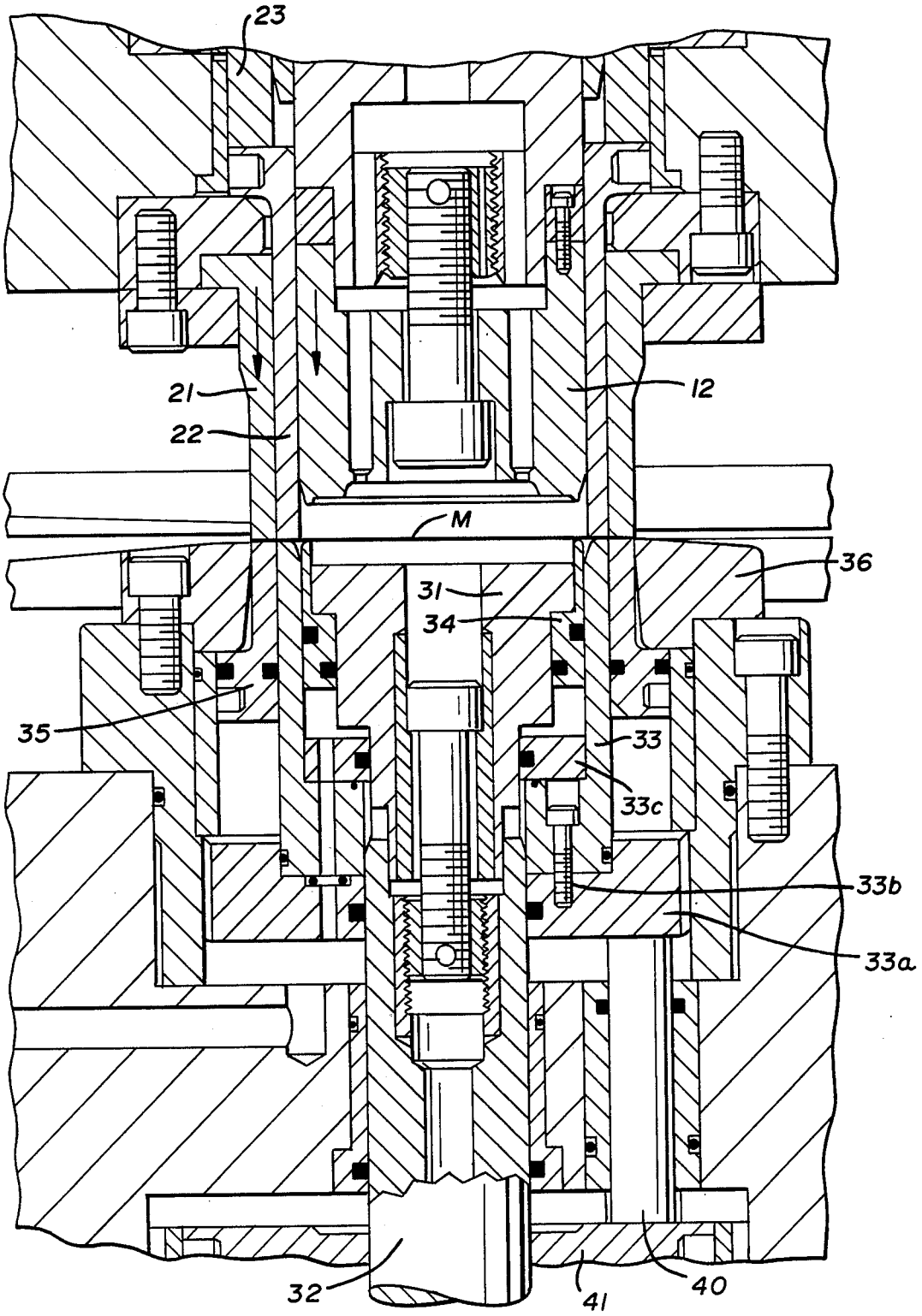
FIG. 2 is an elevational view, partially in section, showing the position of the tooling components just prior to blanking.

In use or operation of the improved apparatus, and referring to FIG. 2 of the drawings, it will be understood that the material M will have been fed into the press, either from sheet or coil stock, and will have been suitably scrolled. FIG. 2 of the drawings illustrates material M in the press between the inner and outer slide holders 10 and 20 on the one hand and the base 30 on the other. At this stage, the inner and outer slides will be advancing toward the base with the inner slide leading the outer slide slightly.

As can be seen in FIG. 2 of the drawings, the punch shell 21 which is fixed to and moves with outer slide holder 20 will have just contacted the material M as will the upper pressure sleeve 22 which is urged downwardly by piston 23. The punch core 12 is still spaced therefrom and has not yet advanced sufficiently to contact the material M.

It will also be noted that the material M is supported at this point on the lower pressure sleeve 35 opposed to the punch shell 21 and by the die core ring 33 opposed to the upper pressure sleeve 22.

Figure 3:
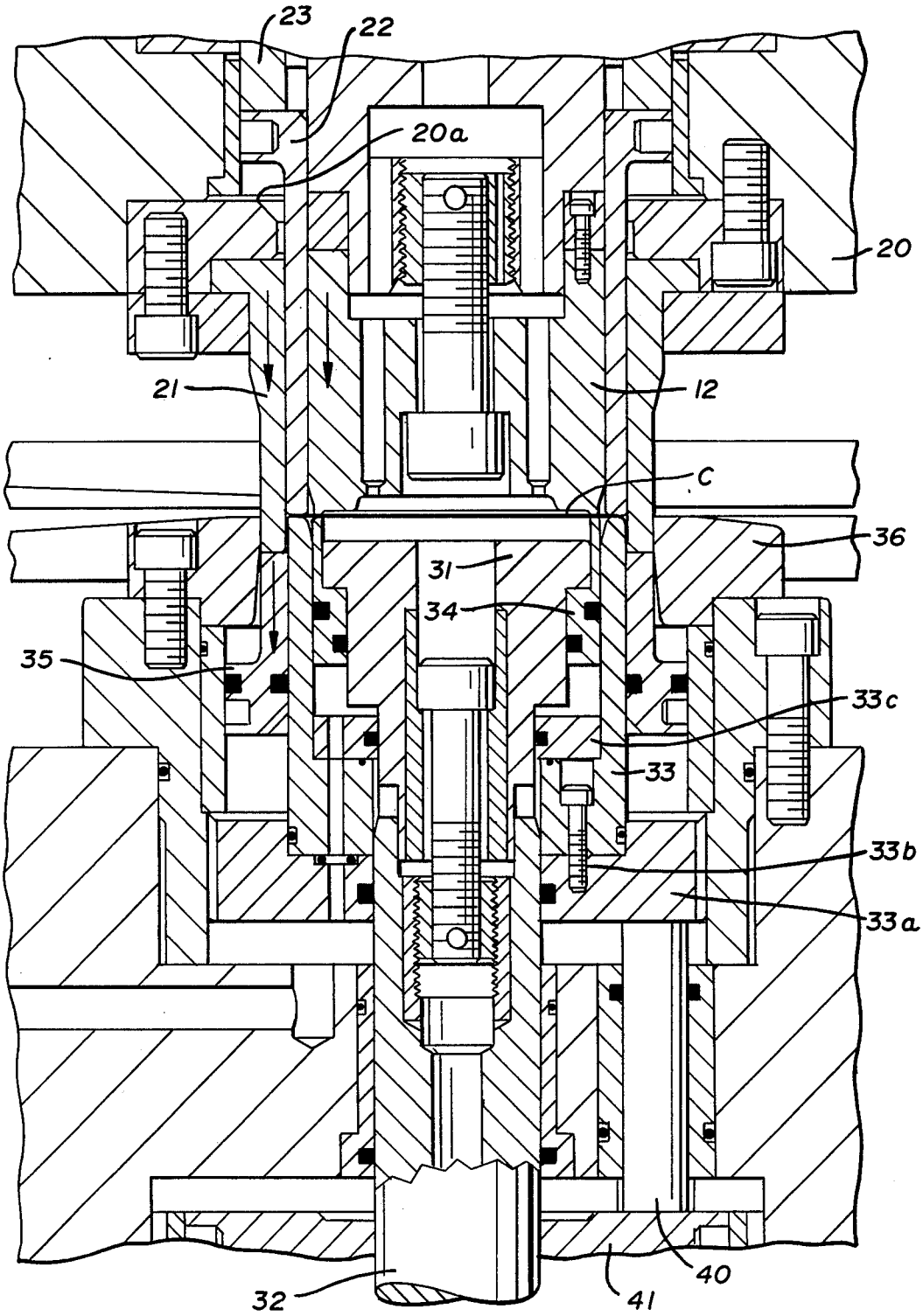
FIG. 3 is an elevational view, partially in section, showing the position of the tooling components following drawing of the reverse or inverted cup.
Figure 3A:
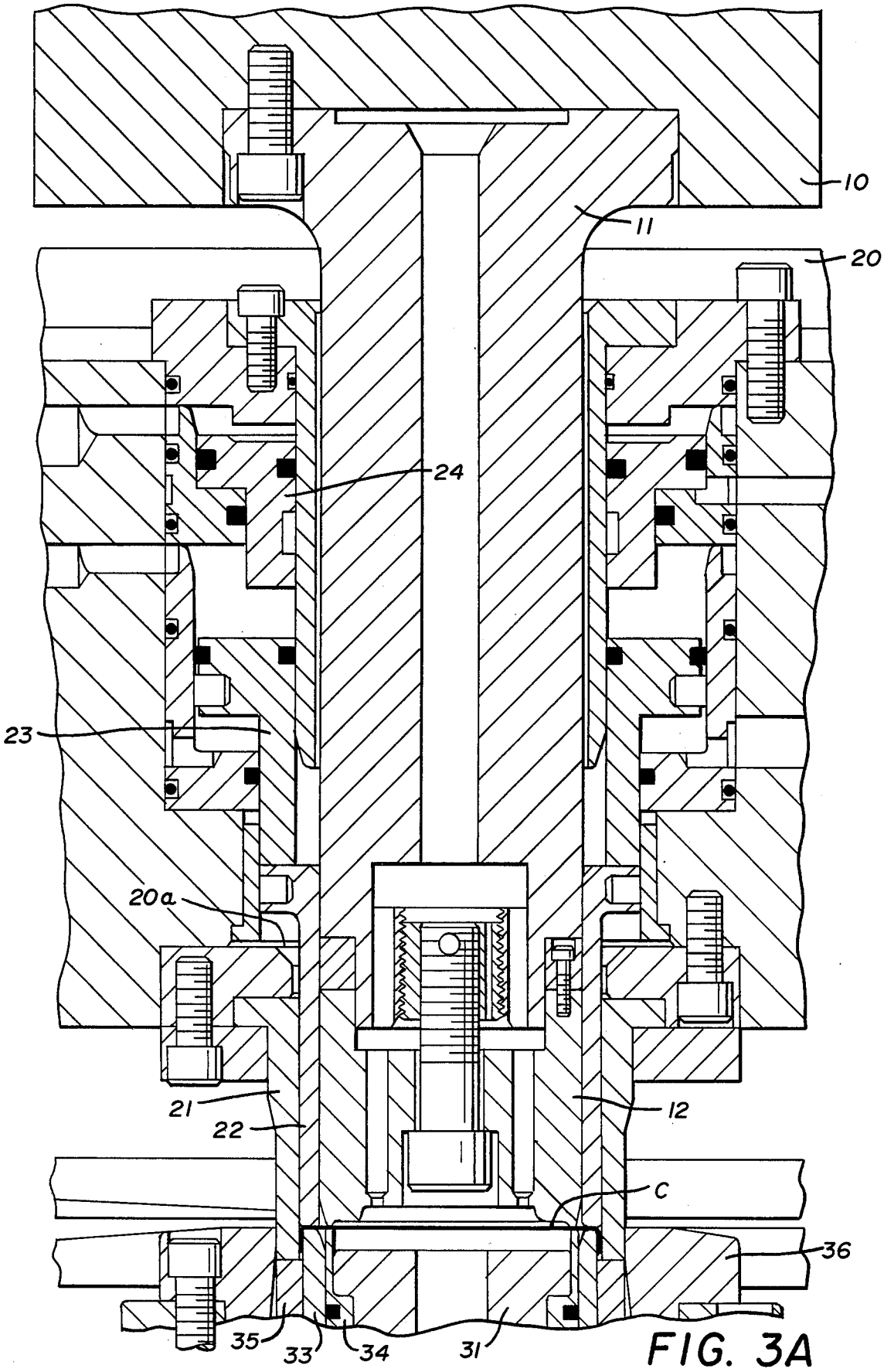
FIG. 3A is a view similar to FIG. 3 showing the position of the pressure sleeve and pistons at this point in the operation.

Further advancement of the inner and outer slides will move the tooling to the position of FIGS. 3 and 3A of the drawings.

Here, it will be noted that the outer slide is advanced so that the punch shell 21 has blanked the material M in cooperation with the die cut edge 36 so as to first form a disk or workpiece. Further advancement of the outer slide advances the punch shell 21 downwardly, overcoming the pressure supporting the lower pressure sleeve 35 and wiping the peripheral edge of the workpiece about the upper end of the die core ring 33 to form an inverted cup C. The die core ring 33, as previously noted, is supported by fluid pressure beneath the pistons 41 and 42 and will be maintained in the position shown in FIG. 3 with the fluid pressure from the piston 23 on the upper pressure sleeve 22 being equalized so that these parts do not move relatively of each other at this point. However, since outer slide holder 20 has continued to move, it has moved away from sleeve 22 which no longer rests on the shoulder 20*a*. It will also be noted that the inner slide has advanced so that the punch core 12 is contacting the upper surface of the cup C.

Figure 4:
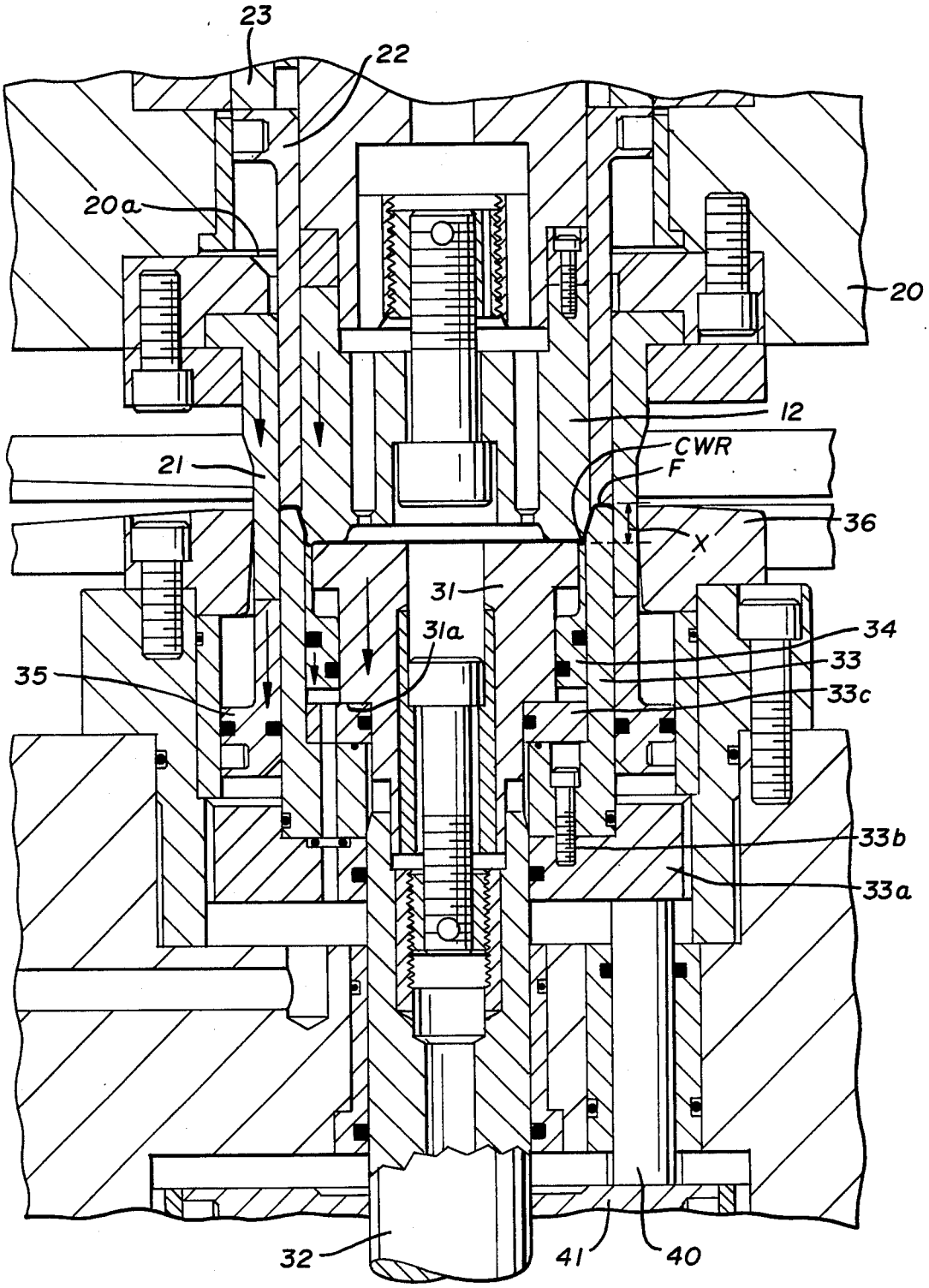
FIG. 4 is an elevational view, partially in section, showing the position of the tooling components with the predetermined depth between the chuckwall radius and the flange determined and with the chuckwall and the bottom panel partially formed.
Figure 4A:
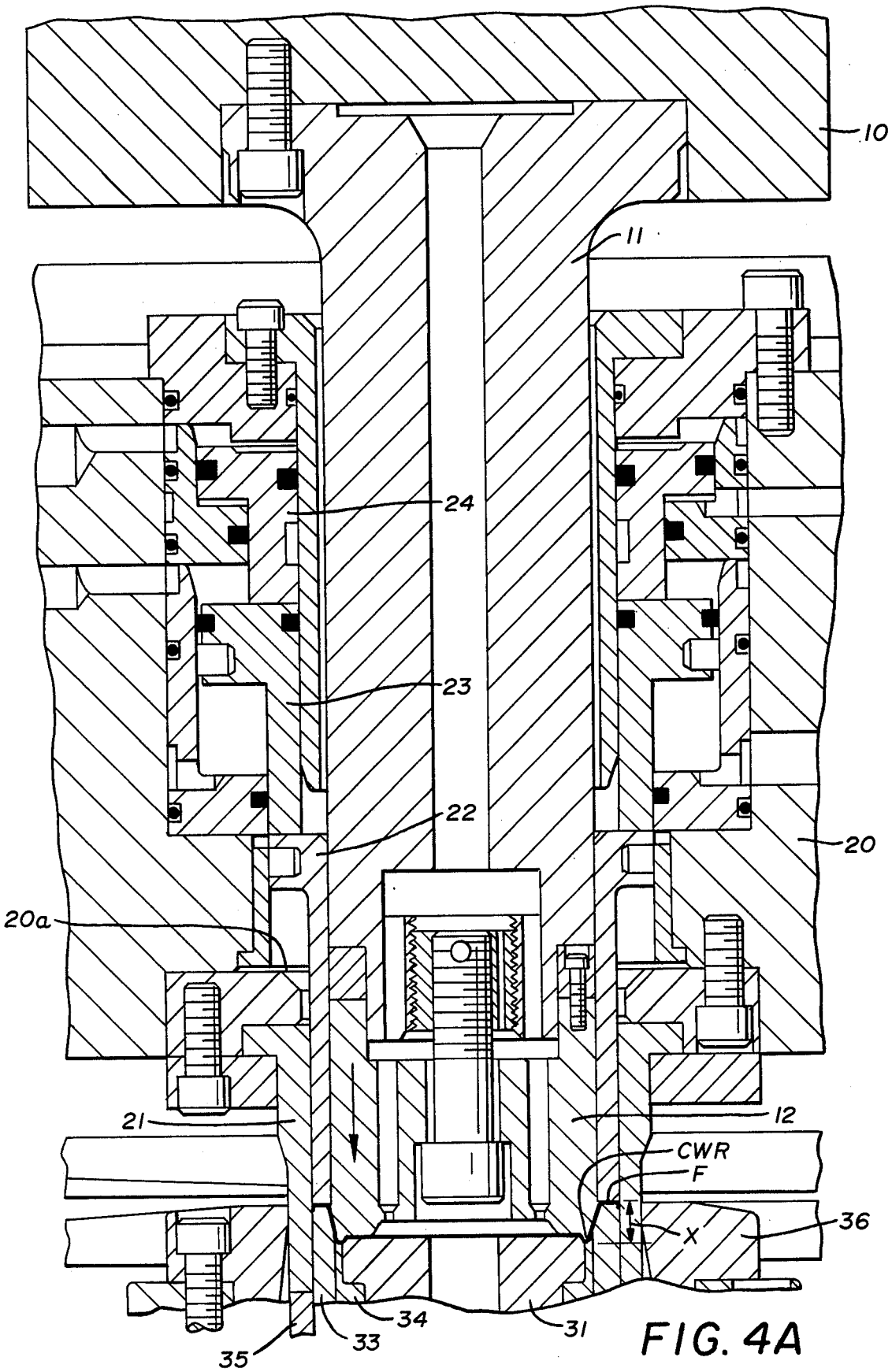
FIG. 4A is a view similar to FIG. 4 showing the position of the pressure sleeve and pistons at this point in the operation.

Further advancement of the inner and outer slides will move the tooling to the position of FIGS. 4 and 4A of the drawings. Here, again, it will be noted that the advancement of the outer slide has moved the punch shell 21 still further down still overcoming the fluid pressure supporting the lower pressure sleeve 35. Additionally, it will be noted that the die core ring 33 and the upper pressure sleeve 22 have not moved relatively of each other and are holding the flange F of the material. It will be noted, however, that the inner slide has continued to advance and that the punch core 12 has preliminarily formed the cup into an end panel with a flange F and a chuckwall radius CWR. It will also be noted that the center panel of the material now rests on the top of die core 31 and that the material is clamped between punch core 12 and die core 31.

At this point, the upper piston 24 comes into contact with the lower piston 23 so that both pistons are acting on pressure sleeve 22.

It further should be noted here that the critical dimension X has now been established between the top of the flange F and the bottom of the chuckwall radius CWR.

Additionally, it is important to note that the shoulder 31*a* of the die core 31 has now engaged the spacer 33*c* of the die core ring 33. Therefore, further downward movement, for any reason, of the punch core 12 will cause the die core 31, the spacer 33*c*, the die core ring 33 and the die core ring pad 33*a* all to move downward, overcoming the fluid pressure from pistons 42 and 43. In this fashion, if there should be any overtravel of the inner slide and, therefore, of the punch core 12, the distance X will not be disturbed.

Figure 5:
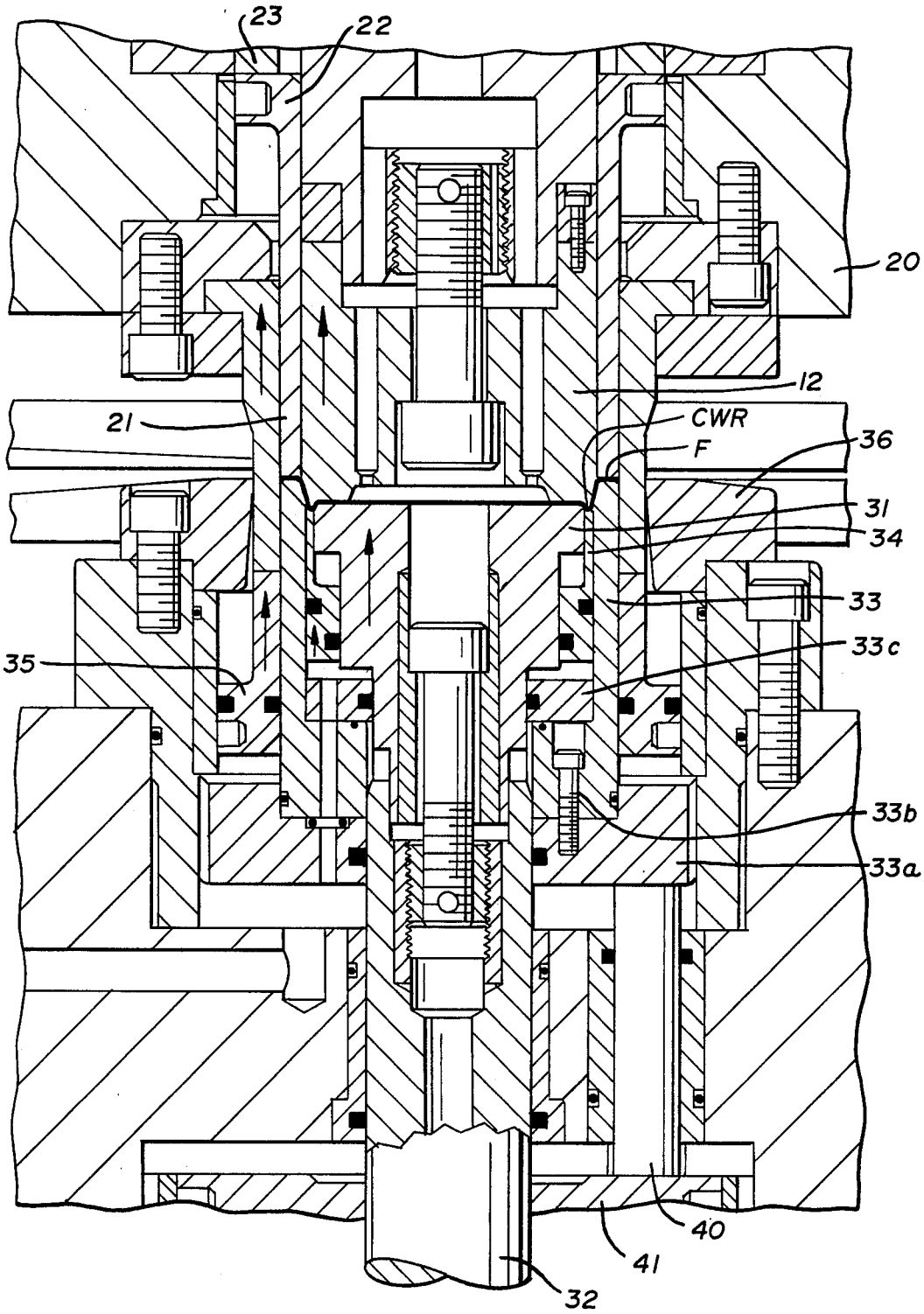
FIG. 5 is an elevational view, partially in section, showing the position of the tooling components upon forming of the bottom panel.
Figure 5A:
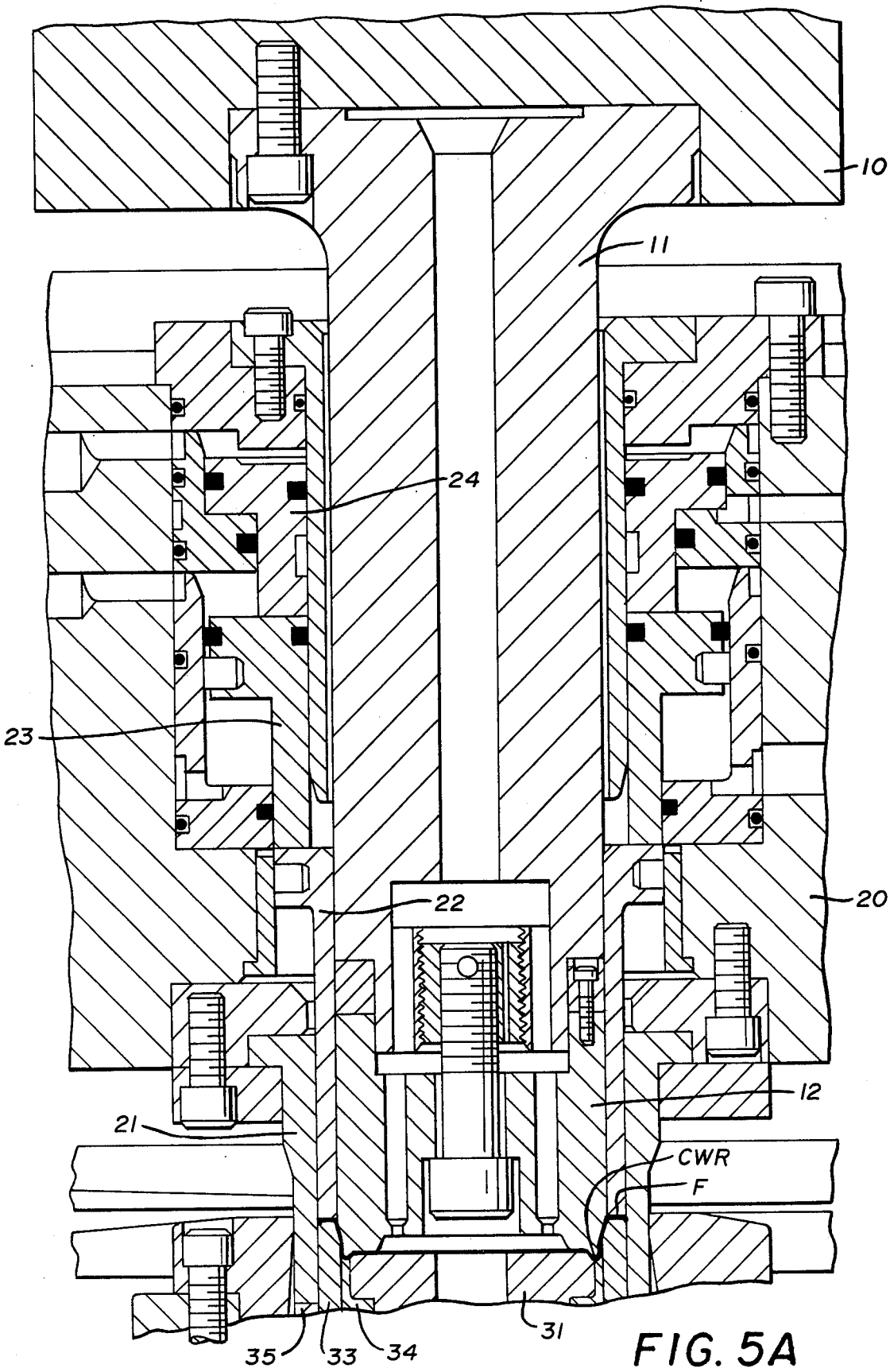
FIG. 5A is a view similar to FIG. 5 showing the position of the pressure sleeve and pistons at this point in the operation.

Referring next to FIG. 5, it will be noted that the final setting of the center panel is accomplished by withdrawing the punch core 12 and moving the die core 31 in the same direction. This resets the chuckwall radius and tightens it up, leaving the dimension X unchanged in all instances. It will also be noted that this all occurs in one operation and that the "gap" or distance X is controlled within the diameter of the workpiece thereby reducing the required working area.

Furthermore, at this point, the outer slide has passed bottom dead center and is moving up as shown by the arrows, but pressure sleeve 22 and pistons 23 and 24 are still stacked up and exerting suitable clamping pressure.

Figure 6:
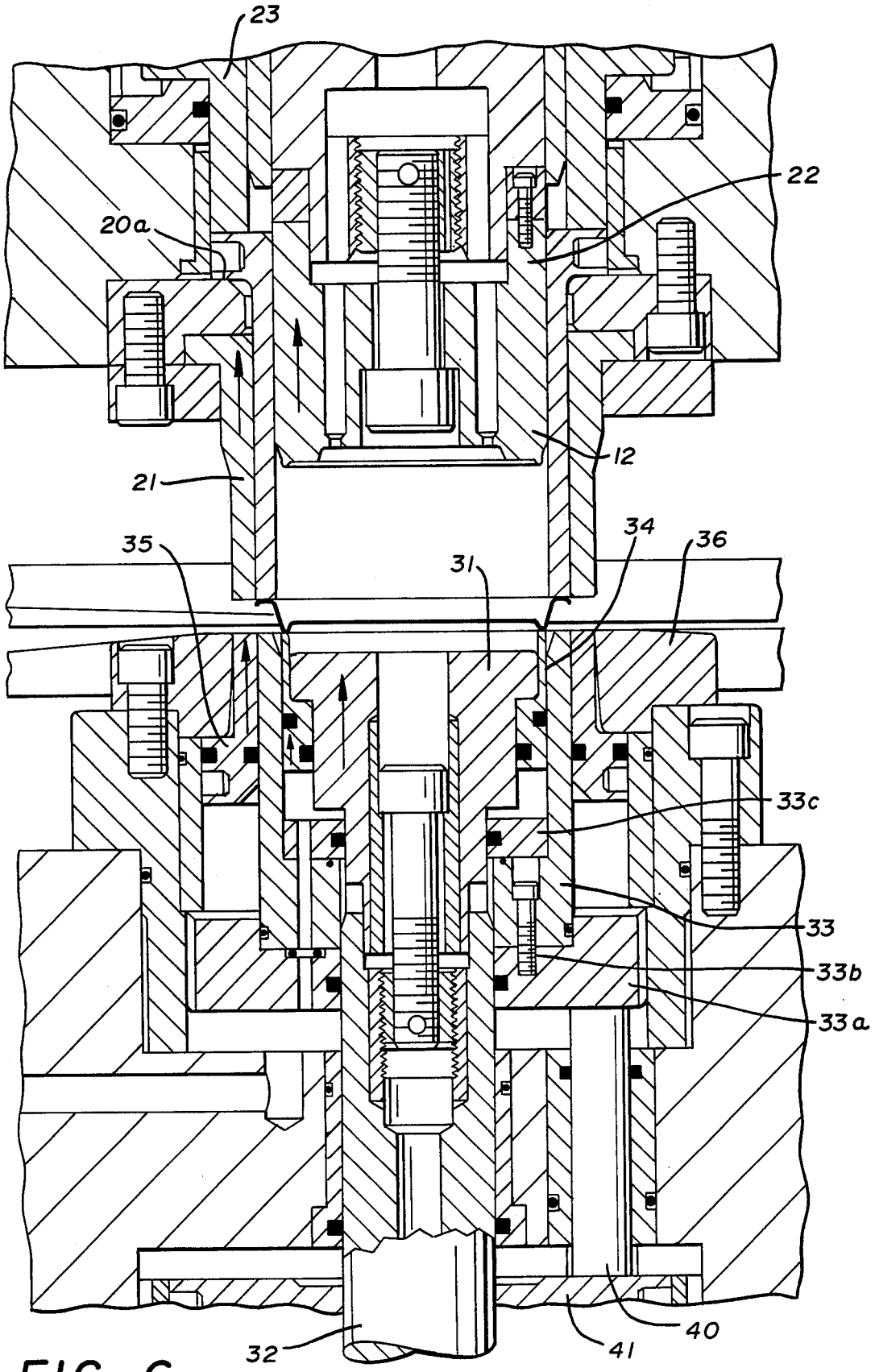
FIG. 6 is an elevational, sectional view of the tooling components showing lift out of the finished end panel.

FIG. 6 of the drawings illustrates the tooling components, of course, in the position for lift out wherein the inner slide has pulled away and taken with it the punch core 12 and the outer slide has also pulled away taking with it the components thereof and primarily taking away the upper pressure sleeve 22 which is reengaged with shoulder 20*a* and the punch shell 21. This permits the knockout 34 to be activated, forcing the finished product up to the die line from which it can be readily removed.

While a full and complete description of the invention has been set forth in accordance with the dictates of the Patent Statutes, it should be understood that modifications can be resorted to without departing from the spirit hereof or the scope of the appended claims.

Thus, and as previously mentioned, the invention has been described and illustrated, by way of example, in connection with the forming of container end panels or shells. However, since the problem of press thermal expansion is not limited by the particular end product being formed in the press, the invention is not necessarily limited thereby either.

Additionally, while the primary problem addressed herein has been thermal expansion, it is believed that the inventive concepts involved are capable of compensating for press variances caused by other factors as well.

What is claimed is:

1. A method of controlling the spacing between a material forming punch carried by a movable slide and a forming die carried by a fixed base in a double acting press, comprising the steps of:

(a) advancing a punch shell and a pressure sleeve into engagement with the material;

(b) holding the material with the pressure sleeve against an opposed die core ring and blanking it by advancing the punch shell;

(c) preliminarily forming the material and establishing a predetermined dimension by engaging a peripheral area of the material between the pressure sleeve and the top of the die core ring and advancing a punch core past the top of the die core ring so as to engage a central area of the material and clamp the same against a die cover; and (d) engaging the normally independently movable and supported die core ring and the die core at the end of step (c) so that further advancement of the punch core will cause the die core and the die core ring to move together while maintaining their relationship with each other.

2. The method of claim 1 wherein said pressure sleeve and said die core ring remain in clamping engagement with the material during step (d).

3. A method of forming a container end panel from a sheet of material, comprising the steps of:

(a) advancing a punch shell and a pressure sleeve into engagement with the sheet of material;

(b) blanking the sheet of material by holding the material with the pressure sleeve against an opposed die core ring and further advancing the blank and draw punch;

(c) forming the material into an inverted cup by further advancing the blank and draw punch and wiping a peripheral edge of the material over an independently fluidly supported die core ring;

(d) preliminary forming an end panel having a peripheral flange, a center panel and a chuckwall and chuckwall radius interconnecting said flange and center panel and establishing a predetermined depth between the chuckwall radius and the flange by advancing a punch core past the top of the die core ring and forcing the material against the top of an independently supported die core;

(e) moving the die core into engagement with said fluidly supported die core ring in step (d) whereby the punch core, die core and die core ring will move together after the predetermined depth of the end panel has been obtained; and (f) resetting the chuckwall radius of the end panel by withdrawing the punch core and advancing the die core toward the punch core.

4. The method of claim 3 wherein said pressure sleeve remains in clamping engagement with the material in steps (c) through (f).

5. Apparatus for controlling the spacing between a material forming punch carried by a movable slide and a forming die carried by a fixed base in a double acting press, comprising:

(a) a pressure sleeve carried by the movable slide;

(b) a die core ring carried by the fixed base in opposed relationship with said pressure sleeve;

(c) a punch core carried by the movable slide movable toward and away from the fixed base and disposed radially inwardly of said pressure sleeve;

(d) a die core carried by the fixed base in opposed relationship with said punch core;

(e) said pressure core being movable toward said die core ring to clamp a peripheral portion of the material thereagainst;

(f) said punch core being movable toward said die core and past the top of said die core ring to form the material and establish a predetermined depth dimension thereto and clamp the central area of the material against said die core;

(g) said die core ring and said die core being movably and independently supported on the fixed base; and (h) said punch core moving said die core into engagement with said die core ring upon establishment of said predetermined depth dimension (1) whereby further movement of said punch core will cause said die core and said die core ring to move together.

6. The apparatus of claim 5 wherein said pressure sleeve is fluidly actuated and maintained in clamping relationship to the material during movement of said punch core toward the fixed base.

7. Apparatus for forming a container end panel from a sheet of material in a double acting press having inner and outer movable slides, comprising:

(a) a punch shell carried on the outer slide of the press;

(b) a lower pressure sleeve carried by the base of the press in opposed relationship with said punch shell;

(c) an upper pressure sleeve carried on the outer slide of the press;

(d) a die core ring fluidly supported on the base of the press in opposed relationship with said upper pressure sleeve; '(e) a punch core carried by the inner slide of the press;

(f) a punch core movably supported on the base of the press in opposed relationship with said punch core;

(g) said punch core being movable toward the base of the press to force the material against said die core and move said die core a predetermined distance against the pressure supporting it;

(h) said die core ring and said die core being movably and independently supported on the fixed base; and (i) said die core engaging said die core ring after moving said predetermined distance whereby said die core and said die core ring are movable together for any further travel of said punch core toward the base of the press.

8. The apparatus of claim 7 wherein said pressure sleeve is fluidly actuated and maintained in clamping engagement with the material at least during movement of said punch core toward the fixed base.

9. The method of claim 1 wherein the punch core is moved away from the fixed base following step (d) and the die core moves in the same direction independently of the die core ring.

* * * * *

UNITED STATES PATENT AND TRADEMARK OFFICE

CERTIFICATE OF CORRECTION

PATENT NO. : 4,800,743

DATED : January 31, 1989

INVENTOR(S) : Bulso, Jr. et al.

It is certified that error appears in the above-identified patent and that said Letters Patent is hereby corrected as shown below:

In Column 2, Line 33, delete "4,624,126" and substitute therefor --4,624,125--.

In Column 3, Line 60, delete "code" and substitute therefor --core--.

In Column 4, Line 6, delete "side" and substitute therefor --slide--.

In Column 4, Line 24, between the words "therewith," and "a", insert the word --is--.

In Column 6, Line 36, delete "cover" and substitute therefor --core--.

UNITED STATES PATENT AND TRADEMARK OFFICE

CERTIFICATE OF CORRECTION

PATENT NO. : 4,800,743

DATED : January 31, 1989

INVENTOR(S) : Bulso, Jr. et al.

It is certified that error appears in the above-identified patent and that said Letters Patent is hereby corrected as shown below:

In Column 7, Line 21, delete the first "core" and substitute therefor --sleeve--.

Signed and Sealed this

Twenty-seventh Day of June, 1989

*Attest:*

DONALD J. QUIGG

*Attesting Officer*

*Commissioner of Patents and Trademarks*